US012070831B2

(12) United States Patent
Le

(10) Patent No.: US 12,070,831 B2
(45) Date of Patent: Aug. 27, 2024

(54) NAIL CLIPPER SHARPENER

(71) Applicant: Phong Le, Peoria, AZ (US)

(72) Inventor: Phong Le, Peoria, AZ (US)

( * ) Notice: Subject to any disclaimer, the term of this patent is extended or adjusted under 35 U.S.C. 154(b) by 1335 days.

(21) Appl. No.: 16/380,067

(22) Filed: Apr. 10, 2019

(65) Prior Publication Data

US 2020/0324382 A1 Oct. 15, 2020

(51) Int. Cl.

| | |
|---|---|
| ***B24B 3/60*** | (2006.01) |
| ***A45D 29/02*** | (2006.01) |
| ***B24B 3/50*** | (2006.01) |
| ***B24B 41/02*** | (2006.01) |
| ***B24D 15/06*** | (2006.01) |
| ***B24D 15/08*** | (2006.01) |
| *B24B 3/36* | (2006.01) |

(52) U.S. Cl.

CPC ..... *B24B 3/60* (2013.01); *A45D 29/02* (2013.01); *B24B 41/02* (2013.01); *B24D 15/06* (2013.01); *B24B 3/36* (2013.01); *B24B 3/50* (2013.01); *B24D 15/081* (2013.01)

(58) Field of Classification Search

CPC ..... B24B 45/00; B24B 45/006; B24B 3/60; B24B 3/605; B24B 3/52; B24B 3/54; B24B 3/50; B24B 3/58; B24B 3/36; B24B 41/02; B24D 15/081; B24D 15/08; B24D 15/084; B24D 15/085; B24D 15/087; B24D 15/06; B24D 15/01; B24D 15/10; B24D 15/105; B24D 15/02; B24D 15/061; B24D 15/063; B24D 15/065; A45D 29/02

See application file for complete search history.

(56) References Cited

U.S. PATENT DOCUMENTS

| | | | | | |
|---|---|---|---|---|---|
| 578,440 | A * | 3/1897 | Beaudin | B24D 15/081 | 76/86 |
| 1,041,631 | A * | 10/1912 | Johnson | B24D 15/081 | 76/86 |
| 2,238,340 | A * | 4/1941 | Poe | B43L 23/006 | 451/518 |
| 2,249,218 | A * | 7/1941 | Meade | B24D 15/081 | 451/486 |
| 2,791,831 | A * | 5/1957 | Hollis | B24D 15/084 | 76/86 |
| 4,627,194 | A * | 12/1986 | Friel | B24B 3/546 | 451/163 |
| 5,199,225 | A * | 4/1993 | Esposito | B24D 15/06 | 451/438 |
| 9,132,530 | B2 * | 9/2015 | Lin | B24D 15/081 | |
| 9,821,436 | B1 * | 11/2017 | Smith | B24D 15/06 | |
| 2008/0163432 | A1 * | 7/2008 | Reid | A01K 97/18 | 451/555 |
| 2009/0056503 | A1 * | 3/2009 | Friesen | B24D 15/081 | 76/82 |

* cited by examiner

*Primary Examiner* — Makena S Markman
(74) *Attorney, Agent, or Firm* — Walt Froloff

(57) ABSTRACT

A curved nail clipper or cutter sharpener having a specific angle V-block abrasive surface with lip having clearance for small jaw short clipper curve cutting edge. A whetting groove transversely is formed in a sharpener supporting V-body block such that the whetting surface assemblies form specific preset and changeable angle V-shaped angles.

5 Claims, 5 Drawing Sheets

NAIL CLIPPER SHARPENER

BACKGROUND

Field of the Invention

The present invention generally relates to manual sharpening tools and in particular to curved clipper sharpeners having clipper cutting edge angle preservation and clearance for small jaw short clipper edges.

Conventional Handheld Sharpeners

A manicurist's nail clipping tool, like most cutting tools, will grow dull even quickly with some use. In many instances, the clipper, not unlike a chef's knife, may need sharpening after every use. The manicurist's nail clippers have notoriously short nose curved cutters, very necessary for the curved nails, but which make the clippers almost impossible to sharpened to a conforming cutting wedge angle.

Classic Sharpeners.

Sharpeners having a cutout recess formed in an end of the handle have come about, where a sharpener body has a whetting groove transversely formed in the sharpener body with a plate-shaped whetstones incline installed on opposing sidewalls of a whetting groove so that the whetstones form a V-shaped arrangement. However, the V-shaped wedge arrangement for the blade which is perfectly adaptable for a long straight knife edge does not accommodate short jawed clipper curved edge. Moreover the V-shaped arrangement is fixed and unchangeable whetting grove.

Other portable cutting-tool sharpeners disclose a compact housing of the box-type, having a central enlarged portion and two aligned, straight sections extending from the opposite sides of the enlarged portion. These have two parallel frame plates secured in one of the aligned straight housing sections, having motorized pulleys keyed to a driving roller journals between the parallel plates used as a driving "V-belt" of an endless abrasive band mounted around the roller and a driving roller and driven by the latter, arranged longitudinally between the parallel frame plates. These having the endless abrasive band exposed to allow sharpening of cutting tools by the moving endless abrasive band. As other sharpeners, this arrangement is adaptable for straight knife surfaces and does not accommodate short jawed clipper curved surfaces. In addition, the V-shaped arrangement is flexible but variably conformable and constantly changing the configuration around the cutting edge to be sharpened.

Other sharpeners have grinding cutting blades with a grinding wheels, having first and second grinding edges. These comprises rough grinding at least one surface of the cutting blade with the first grinding edge and finish grinding at least one surface of the cutting blade with the second grinding edge. These grinding edge guides controlling the abrasion provide respective angles of nominally 17 degrees and 20 degrees, and a reverse angle guide at nominally 22 degrees. These ranges exist because of the flexibility in the band and not suitable for strict stationary requisite angles which allow the user of a clipper to select only a range of angles for a given sharpening operation because the band will bend slightly as the blade is applied to the band abrasive.

SUMMARY

The present invention discloses a hand-held sharpener device for sharpening short nose curved nail clippers having a whetting groove transversely formed in a sharpener supporting V-body block and the V-body block having two rectangular flat plate-shaped whetting surface assemblies inclinedly installed on two opposing sidewalls of a V-body block groove such that the whetting surface assemblies form specific preset and changeable angle V-shaped angles. The two rectangular plate-shaped whetting surface assemblies protruding beyond the v-block body and forming a cantilevered V-edge lip providing an extended sharpening surface beyond of the V-block body with a $1^{st}$ flat plate-shaped whetting assembly having an rectangular frame with a frame held insert-removable flat plate having two flat sides, a side 1 fitting inside the frame and flush with the V-block, and a side 2 having an abrasive or whetting surface facing a $2^{nd}$ flat plat-shaped whetting surface assembly. The $2^{nd}$ flat plate-shaped whetting assembly having an installed rectangular frame with an insert-removable held fitting wedge cross-section rectangular perimeter piece having two sides with the insertable-removable $2^{nd}$ frame held fitting wedge cross-section piece angle having numerical values in compliance with a pre-set total V abrasion wedge cross-section specific angles corresponding to sharpener cutting edge cross-section angles. A side 1 snuggly fitting held inside the $2^{nd}$ assembly frame and flush with the $2^{nd}$ assembly adjacent V-block surface, and a wedge piece side 2 having an abrasive or whetting surface facing the $1^{st}$ rectangular flat plat-shaped assembly whetting surface such that a curved short head nail cutter with a specific angle wedge cross-section cutting edge can be sharpened to its specific angle edge sharpening with the same abrasion surface angle without being impeded by the sharpener block and handle.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

The present invention discloses a compact portable sharpener for a curved jaw or nose short mouth nail clipper. The geometry of such clippers allows cutting edge preserving abrasion surface sharpeners sharpen a very limited number of times before the nail cutting edge wedge angle becomes too thick to sharpen.

An object of the invention is to provide a sharpening tool for short nosed curved clippers or cutters.

Another object of the invention is to provide a portable sharpener with holder.

Yet another object of the invention is to provide a sharpener which conforms even a slightly curved dull edge to a specific cutting edge cross-section.

Figure 1:
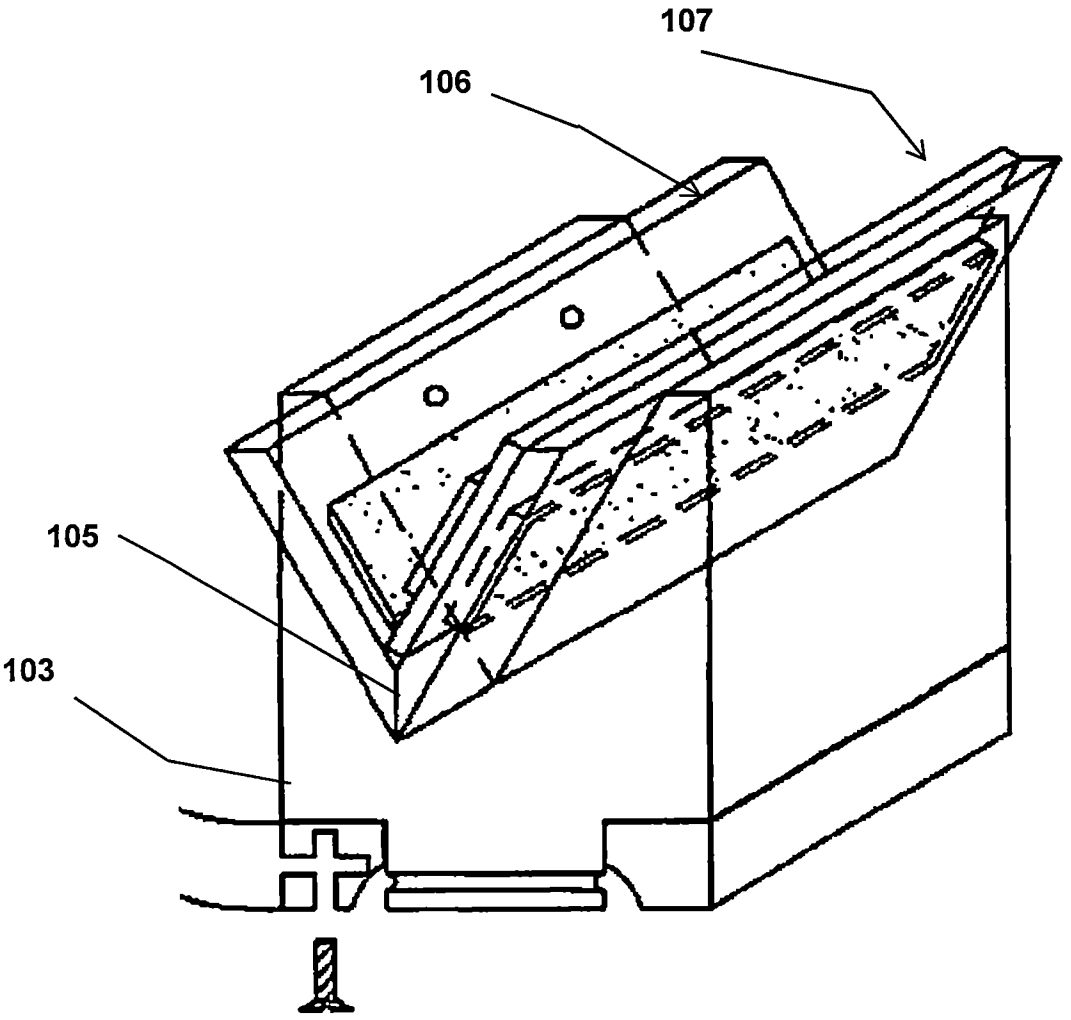
FIG. 1 is an isometric diagram of a sharpener in according to an embodiment of the present invention.

FIG. 1 is an isometric diagram of a sharpener in according to an embodiment of the present invention.

A hand-held sharpener device showing V-body block 103 having two rectangular flat plate-shaped whetting surface assemblies 106, 107 inclinedly installed on two opposing sidewalls of a V-body block 103 groove. The whetting is groove transversely formed in a sharpener supporting V-body block. The two rectangular plate-shaped whetting surface assemblies 106, 107 are protruding beyond the v-block body 103 and forming a cantilevered V-edge lip 105 establishing an extended sharpening surface beyond of the V-block body. Thus a curved short head nail cutter with a specific angle wedge cross-section cutting edge can be sharpened to its specific angle cutting edge sharpening with the same abrasion surface angle without being impeded by the sharpener block 103 and handle.

Figure 2:
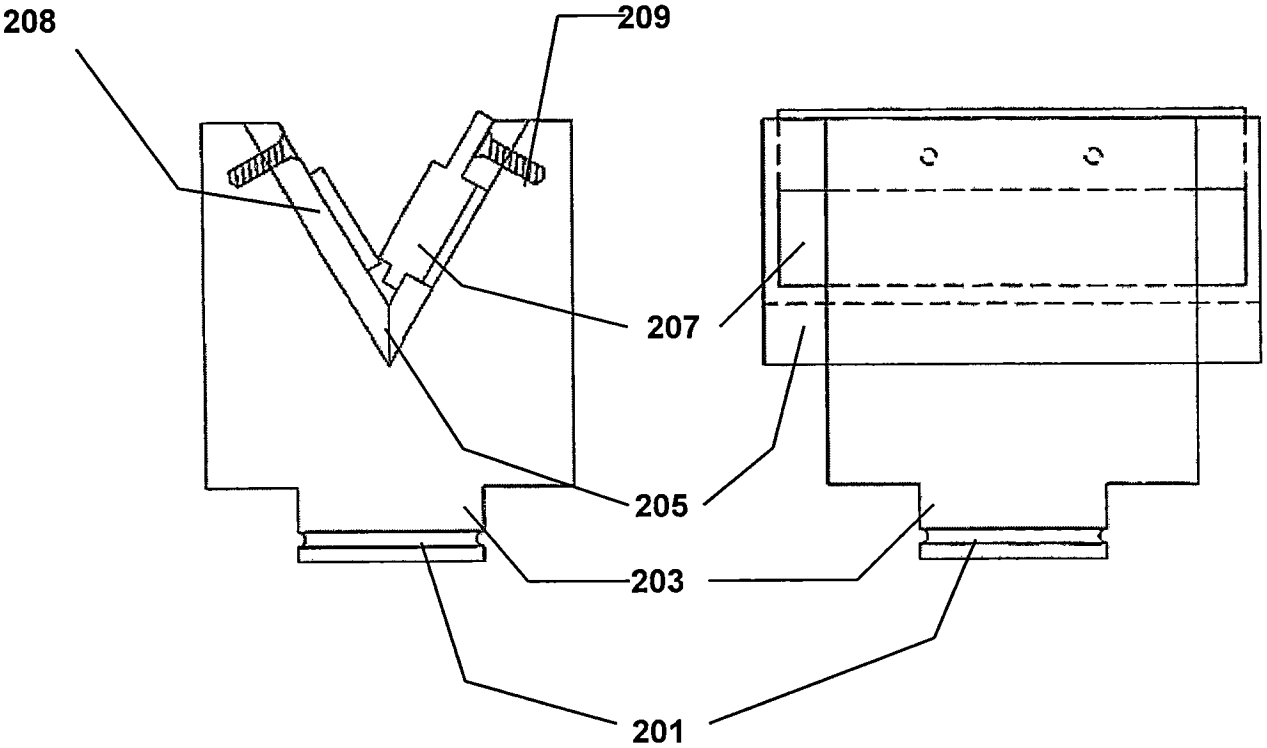
FIG. 2 is a front and side view of a sharpener in accordance with an embodiment of the invention.

FIG. 2 is a front and side view of a sharpener in accordance with an embodiment of the invention.

The sharpener device is specifically for sharpening short nose curved cutters and clippers has slidable lip 201 rigidly coupled to a V-block 203. The V-block 203 has rectangular flat plate-shaped whetting surface assemblies 207 208 adjacent and rigidly coupled 209 to secure inward facing abrasive surfaces whetting groove. The whetting groove is formed in a sharpener surface supporting V-body block for back-and-forth sharpening of short nosed cutters. The two rectangular flat plate-shaped whetting surface assemblies 207, 208 are inclinedly installed on two opposing sidewalls of a V-body block groove such that the whetting surface assemblies form specific preset and changeable angle V-shaped angles. The two rectangular plate-shaped whetting surface assemblies protruding beyond the v-block body and forming a cantilevered V-edge lip 205 providing an extended sharpening surface beyond of the V-block body 203.

Figure 3:
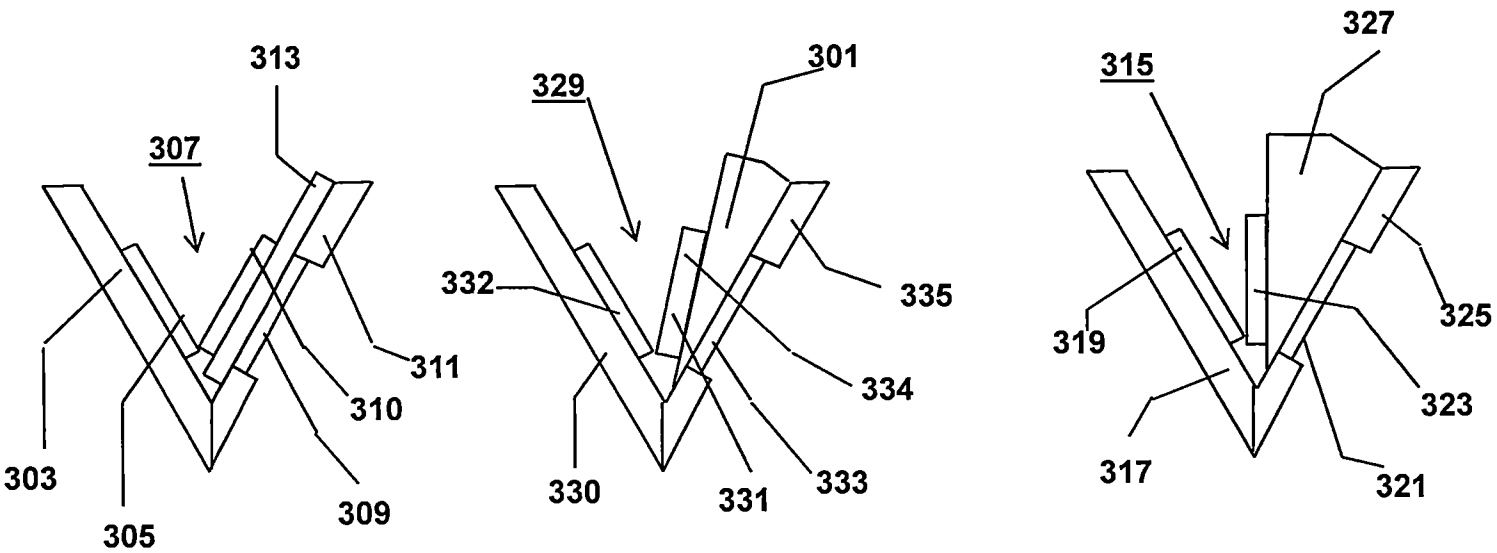
FIG. 3 a cross-sectional view of a sharpener blade assembly in accordance with an embodiment of the invention.

FIG. 3 a cross-sectional view of a sharpener blade assembly in accordance with an embodiment of the invention. Clipper cross-sections are generally made for specific wedge angles. These may be for example x°, y°, and z°. Therefore an aspect of the invention is to match the cutter cross-section angle with an equal sharpening angle, so as to sharpen only the cutter meet to the original angle, preserving the cutter for any future re-sharpening without changing the cutter angle.

A $1^{st}$ flat plate-shaped whetting assembly having a rectangular frame 303, 330, 317 with a frame held insert-removable flat plate 305, 332, 319 having two flat sides, a side 1 fitting inside the frame 303, 330, 317 and flush with a V-block, and a side 2 having an abrasive or whetting surface facing a $2^{nd}$ flat plate-shaped whetting surface assembly 310, 334, 323. The $2^{nd}$ flat plate-shaped whetting assembly having an installed rectangular frame 311, 335, 325 with an insert-removable held fitting wedge cross-section rectangular component 313, 301, 327 having two sides. The insert-removable $2^{nd}$ frame held fitting wedge cross-section piece 313, 301, 327 angle having numerical values in compliance with a pre-set total V abrasion angles 307, 329, 315 specific to standard hand held sharpener cutting edges angles. A side 1 309, 333, 321 snuggly fitting and held inside the $2^{nd}$ assembly frame 311, 335, 325 respectively and flush with the $2^{nd}$ assembly adjacent V-block surface, and a side 2, opposite side 1 (309, 333, 321), having an abrasive or whetting surface facing the abrasive or whetting surface of the $1^{st}$ rectangular flat plate-shaped assembly 305, 332, 319 respectively. The pre-set total V abrasion wedge cross-section specific angles 307, 327, 315 are 30°, 45°, or 60° respectively.

Figure 4:
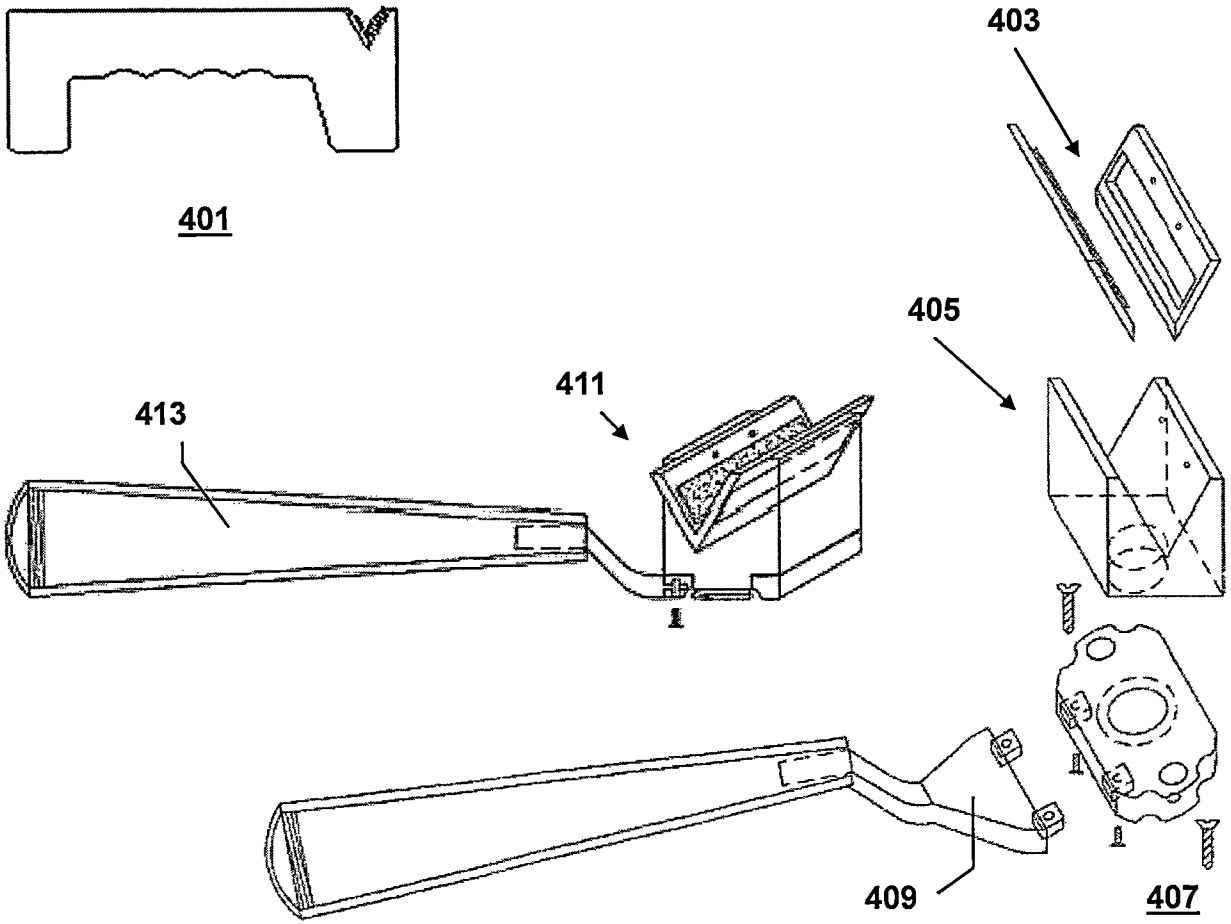
FIG. 4 illustration of a sharpener and assembly with a handle in accordance with an embodiment of the invention FIG. 5 illustration of a sharpener with a ratably insertable handle in accordance with an embodiment of the invention

FIG. 4 is an illustration of a sharpener with sharpener assembly and handles in accordance with embodiments of the invention.

In an embodiment V-block grip handle 401 is shown. In addition a shaver-like handle 413 is shown rigidly coupled to a V-block 405 via an insert attaching arm 409 to a V-block base side coupler 407 rigidly attached to a V-block 405 which is coupled to at least two whetting surface assemblies 403 facing each other and forming a V-shaped groove 411 with block overhanging lip for sharpening small nose cutters to their full cutter nose length without sharpener block impediment. Thus a sharpener can be held steady via a grip handle or a shaver-like handle which allow the user sufficient lateral clearance for a short nose cutter to be sharpened along its total cutting length.

Figure 5:
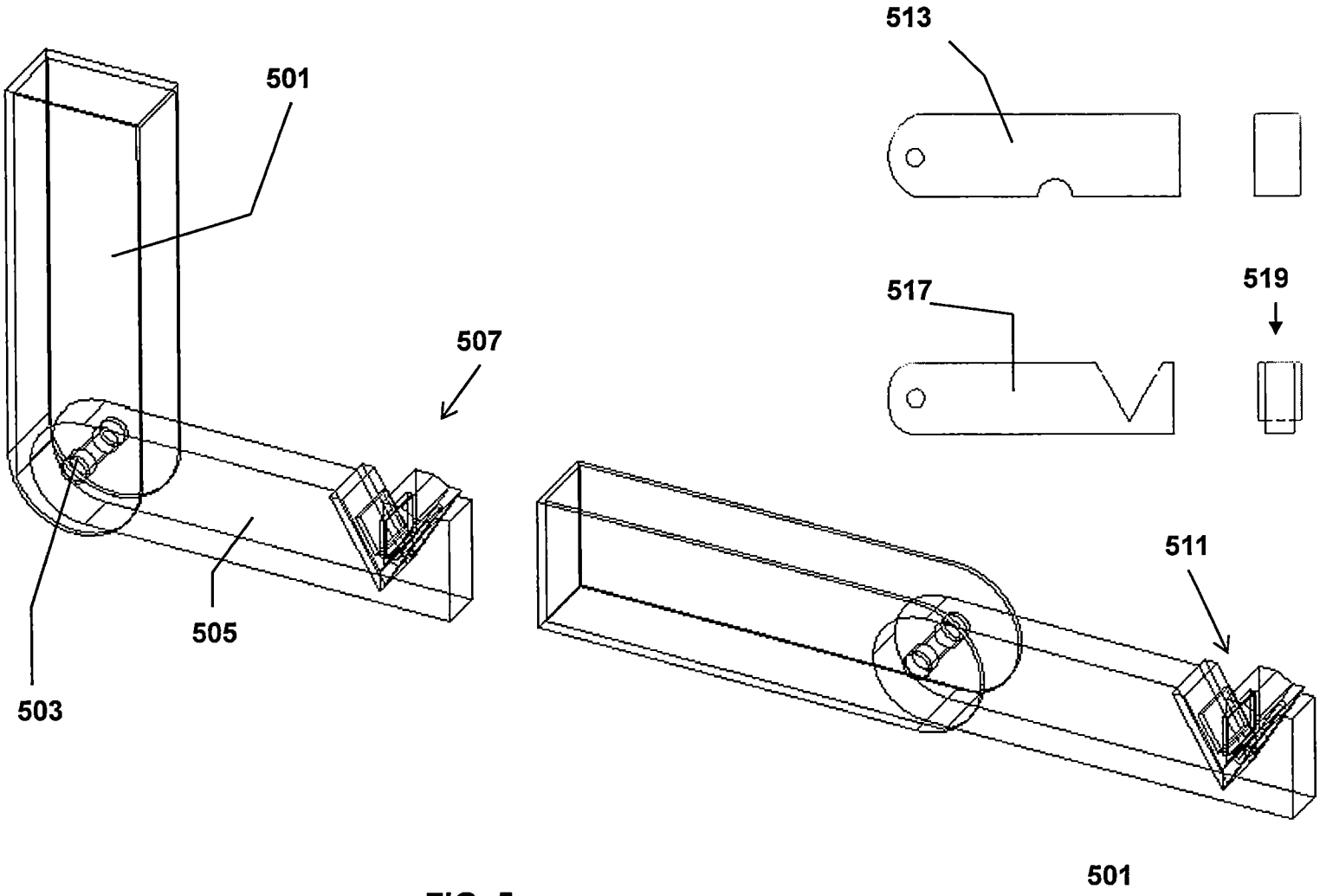

FIG. 5 illustration of a sharpener with a ratably insertable handle in accordance with an embodiment of the invention A handle 501, 513 is rotatably coupled 503 to an extended V-block 5051 517 respectively, with two V-block insert facing rectangular plate-shaped whetting surface assemblies 507, 511 each protruding 519 as shown in the crossection, extending beyond the v-block body 517 and forming a cantilevered V-edge lip 519 establishing an extended sharpening surface beyond of the V-block body.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. A hand-held sharpener device for sharpening short nose curved nail clippers, comprising:

a V-block handle;

a V-body block having a whetting groove, the whetting groove extending transversely across the V-body block;

the V-body block having two rectangular flat plate-shaped whetting surface assemblies configured to be inclinedly installed on two opposing sidewalls of the V-body block, the whetting groove extending between the two opposing sidewalls, groove-such that the rectangular flat plate-shaped whetting surface assemblies are configured to form specific preset V-shaped abrasion angles;

the two rectangular flat plate-shaped whetting surface assemblies each comprising a length extending across and protruding beyond the V-body block, and forming a cantilevered V-edge lip providing an extended sharpening surface beyond the V-body block;

a $1^{st}$ flat plate-shaped whetting assembly, of the two rectangular flat plate-shaped whetting assemblies, having a rectangular frame configured to removably hold an insertable first flat plate in the V-body block when the rectangular frame is installed on a first opposing sidewall of the two opposing sidewalls, a first side of the first flat plate fitting inside the rectangular frame that is parallel and flush with the first opposing sidewall, and a second side of the first flat plate having an abrasive or whetting surface;

a $2^{nd}$ flat plate-shaped whetting assembly, of the two rectangular flat plate-shaped whetting assemblies, having a rectangular frame configured to be installed on a second opposing sidewall of the two opposing sidewalls, the rectangular frame of the $2^{nd}$ flat plate shaped whetting assembly configured to removably hold a plurality of insertable wedge cross-section rectangular perimeter pieces, wherein each wedge cross-section piece has two opposing flat sides, wherein the two opposing flat sides of each of the wedge cross-section pieces are disposed at an angle relative to one another, wherein each angle is a pre-set numerical value comprising one of a plurality of V-block wedge cross-section specific angles, and wherein a first flat side, of the two opposing flat sides of each of the wedge cross-section pieces, is configured to fit and be held inside the rectangular frame of the $2^{nd}$ flat plate-shaped whetting assembly in a manner that is flush with the rectangular frame of the $2^{nd}$ flat plate-shaped whetting assembly, wherein a second flat side, of the two opposing flat sides of each of the wedge cross-section pieces, has an abrasive or whetting surface facing the abrasive or whetting surface of the first flat plate when the first flat plate is inserted in the rectangular frame of the $1^{st}$ rectangular flat plate-shaped assembly, and whereby together the abrasive or whetting surface of the first flat plate, inserted in the rectangular frame of the $1^{st}$ flat plate-shaped whetting assembly, with each one of the abrasive or whetting surface of the wedge cross-section pieces form the specific preset V-shaped abrasion angles, and are configured to sharpen a short nose curved nail clipper without being impeded by the V-body block and the V-block handle.

2. The hand-held sharpener device for sharpening short nose curved nail clippers in claim 1, wherein the V-block handle comprises an extended v-block handle, the extended V-block handle rigidly coupled to the V-body block via an insertable arm for attaching to a V-block base slide coupler rigidly, wherein the V-block base slide coupler is configured for supporting the V-body block coupled to the two rectangular flat plate-shaped whetting surface assemblies, wherein the two rectangular flat plate-shaped whetting surface assemblies face one another and form the whetting groove and the cantilevered V-edge lip for sharpening short nose curved nail clippers.

3. The hand-held sharpener device for sharpening short nose curved nail clippers in claim 1, wherein the wedge cross-section pieces each comprise a different angular thicknesses for forming the specific preset pre-set V-shaped abrasion angles.

4. The hand-held sharpener device for sharpening short nose curved nail clippers in claim 1, wherein the V-block handle comprises a foldable inserting V-block handle rotatable coupled to the V-body block, and wherein the abrasive or whetting surface of the first flat plate and each abrasive or whetting surface of the wedge cross section pieces each protrude beyond the V-body block and form the cantilevered V-edge lip to establish the extended sharpening surface beyond V-body block.

5. The hand-held sharpener device for sharpening short nose curved nail clippers in claim 1, wherein the V-block wedge cross-section specific angles are selected from the group consisting of 30°, 45°, or 60°.

* * * * *